US005119958A

United States Patent [19]

Gabert et al.

[11] Patent Number: 5,119,958

[45] Date of Patent: Jun. 9, 1992

[54] SORT AND CYCLE BIN

[76] Inventors: Robert Gabert, 608-84 Ave. S.W., Calgary Alberta, Canada, T2V 0V7; George Spector, 233 Broadway Rm 3815, New York, N.Y. 10007

[21] Appl. No.: 731,073

[22] Filed: Jul. 15, 1991

[51] Int. Cl.[5] ..... B65D 25/16

[52] U.S. Cl. ..... 220/404; 220/909

[58] Field of Search ..... 220/909, 404, 523; 229/DIG. 3, DIG. 4

[56] References Cited

U.S. PATENT DOCUMENTS

| | | | |
|---|---|---|---|
| 1,424,519 | 8/1922 | Richardson | 220/404 |
| 1,938,452 | 12/1933 | Griesmeyer | 220/404 |
| 2,625,973 | 1/1953 | Weldon et al. | 220/404 |
| 2,757,859 | 8/1956 | Holland | 220/404 |
| 3,893,615 | 7/1975 | Johnson | 220/404 |
| 4,418,835 | 12/1983 | Watts | 220/404 |
| 4,905,853 | 3/1990 | Strawder | 220/404 |
| 4,974,746 | 12/1990 | Dickinson | 220/404 |

*Primary Examiner*—Joseph Man-Fu Moy

[57] ABSTRACT

A sort an cycle bin is provided for waste materials which consists of a receptacle having a front wall, a rear wall, a bottom wall and a pair of side walls with a plurality of horizontally oriented and vertically spaced apart compartments. Indicia is associated with the compartments, for visually indicating the type of waste material to be placed in each compartment. A removable container is to be placed into each compartment for receiving one type of waste material that will be placed therein. A mechanism is for suspending each of the removable containers within each of the compartments. Each of the different waste materials can be placed into each of the removable containers and then be removed to facilitate its transportation to a recycling facility. A lid is hinged to a top edge of the rear wall of the receptacle, so that when the lid is placed in a closed position it will cover the compartments.

2 Claims, 1 Drawing Sheet

SORT AND CYCLE BIN

BACKGROUND OF THE INVENTION

The instant invention relates generally to trash receptacles and more specifically it relates to a sort and cycle bin which provides a compartment for holding bags wherein to organize recyclable items.

There are available various conventional trash receptacles which do not provide the novel improvements of the invention herein disclosed.

SUMMARY OF THE INVENTION

A primary object of the present invention is to provide a sort and cycle bin that will overcome the shortcomings of the prior art devices.

Another object is to provide a sort and cycle bin that includes a compartment for holding a plurality of bags therein to organize recyclable items in the home, office or apartment.

An additional object is to provide a sort and cycle bin in which the compartment contains a plurality of hooks, while each bag contains a plurality of loops to engage matching hooks so as to be supported therefrom.

A further object is to provide a sort and cycle bin that is simple and easy to use.

A still further object is to provide a sort and cycle bin that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
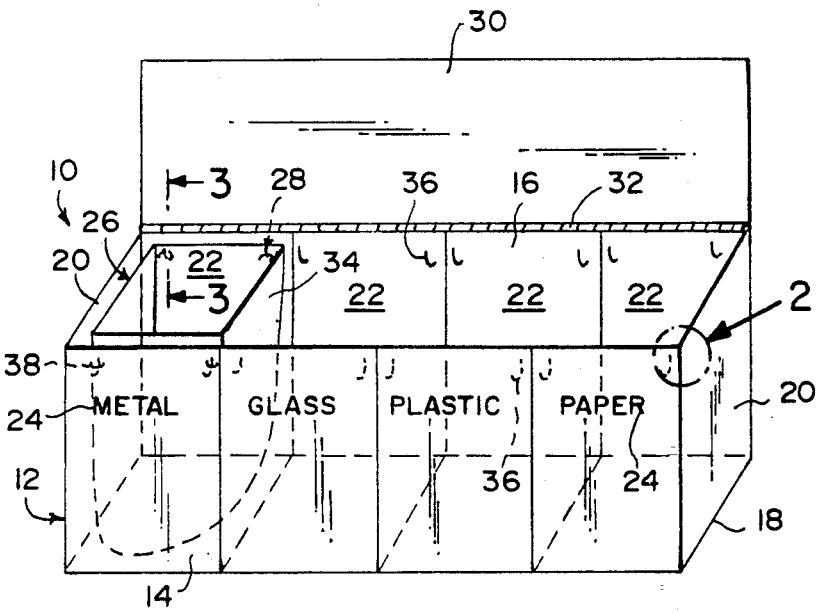
FIG. 1 is a perspective view of the instant invention.
Figure 2:
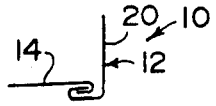
FIG. 2 is an enlarged view of a typical corner as indicated by arrow 2 in FIG. 1.

Turning now descriptively to the drawings, in which similar reference characters denote similar elements throughout the several views, the Figures illustrate a sort and cycle bin 10 for waste materials which consists of a receptacle 12 having a front wall 14, a rear wall 16, a bottom wall 18 and a pair of side walls 20 with a plurality of horizontally oriented and vertically spaced apart compartments 22. Indicia 24 is associated with the compartments 22, for visually indicating the type of waste material to be placed in each compartment 22. A plurality of removable containers 26 are also provided. Each container 26 is to be placed into one compartment 22 for receiving one type of waste material that will be placed therein. A mechanism 28 is for suspending each of the removable containers 26 within each of the compartments 22, so that each of the different waste materials can be placed into each of the removable containers 26 and then be removed to facilitate its transportation to a recycling facility. A lid 30 is hinged at 32 to a top edge of the rear wall 16 of the receptacle 12, so that when the lid is placed in a closed position it will cover the compartments 22.

The visually indicating indicia 24, such as the words METAL, GLASS, PLASTIC, PAPER, etc. is on the front wall 14 of the receptacle 12 at each compartment 22 designating its predetermined type of waste material. Each removable container 26 is a plastic bag 34 which can be normally discarded along with its contents being the respective waste material.

Figure 3:
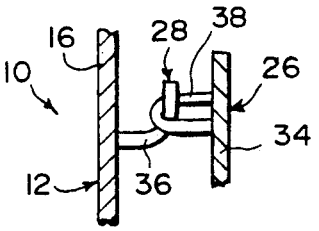
FIG. 3 is a cross sectional view taken along line 3—3 in FIG. 1 showing the hook and loop connection.

The suspending mechanism 28, as shown in FIGS. 1 and 3, includes a plurality of spaced apart hooks 36 affixed to an upper inner surface of the front wall 14 and rear wall 16 of the receptacle 12, in which two of the hooks 36 are located on the front wall 14 and two of the hooks 36 are located on the rear wall 16 in each compartment 22. A plurality of spaced apart loops 38 are affixed to the upper outer surfaces of the plastic bags 34, in which two of the loops 38 are located on one side and two of the loops 38 are located on an opposite side of each plastic bag 34. The loops 38 can engage with the hooks 36, allowing the bags 34 to hang therefrom in the compartments 22 of the receptacle 12.

Figure 4:
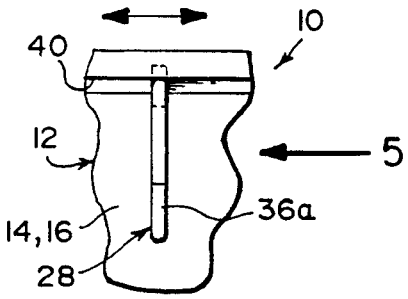
FIG. 4 is a front view of an adjustable hook.
Figure 5:
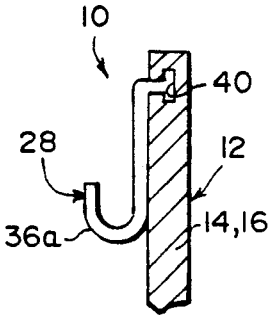
FIG. 5 is a side view taken in direction of arrow 5 in FIG. 4 showing the adjustable hook configuration therein.
Figure 6:
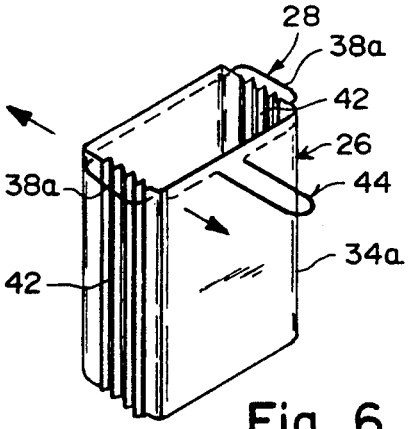
FIG. 6 is a perspective view of an expandable plastic bag with a draw string to engage the adjustable hooks and seal the plastic bag when full.

The suspending mechanism 28, as shown in FIGS. 4, 5 and 6, includes the receptacle 12 having a pair of longitudinal tracks 40, in which the first tracks 40 is located in an upper inner surface of the front wall 14 and the second track 40 is located in an upper inner surface of the rear wall 16. A plurality of hooks **36*a* are adjustably carried in the tracks 40. Each plastic bag 34 has positioned opposite from each other expansion walls 42 to engage the plastic bag 34*a*. A draw string 44 extends through an upper end of the plastic bag 34*a*, so that opposite portions of the draw string 44 can act as a lop 38*a* to engage with two of the hooks 36*a*, allowing the bag 34*a* to hang therefrom in its enlarged condition to hold more waste material therein. When the plastic bag 34*a* is to be discarded, the pull string 44** can close the upper end thereof.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A sort and cycle bin for waste materials which comprises:

a) a receptacle having a front wall, a rear wall, a bottom wall and a pair of side walls with a plurality of horizontally oriented and vertically spaced apart compartments;

b) means associated with the compartments, for visually indicating the type of waste material to be placed in each compartment;

c) a plurality of removable containers, each to be placed into one compartment for receiving one type of waste material that will be placed therein;

d) means for suspending each of said removable containers within each of the compartments, so that each of the different waste materials can be placed into each of said removable containers and then be removed to facilitate its transportation to a recycling facility; and e) a lid hinged to a top edge of the rear wall of said receptacle, so that when said lid is placed in a closed position it will cover the compartments; wherein said visually indicating means includes indicia on the front wall of said receptacle at each compartment designating its predetermined type of waste material; wherein each said removable container is a plastic bag which can be normally discarded along with its contents being the respective waste material; wherein said suspending means includes;

f) said receptable having a pair of longitudinal tracks, in which the first track is located in an upper inner surface of the front wall and the second track is located in an upper inner surface of the rear wall;

g) a plurality of hooks adjustably carried in the tracks;

h) each said plastic bag having positioned opposite each other expansion walls to enlarge said plastic bag; and i) a plurality of drawstrings, each extending through an upper end of each said plastic bgg, so that opposite portions of said drawstring can act as a loop to engage with two of said hooks, allowing said bag to hang therefrom in its enlarged condition to hold more waste material therein and then when said plastic bag is to be discarded said pull string can close the upper end thereof.

2. A sort and cycle bin for waste materials which comprises:

a) a receptacle having a front wall, a rear wall, a bottom wall and a pair of side walls with a plurality of horizontally oriented and vertically spaced apart compartments;

b) means associated with the compartments, for visually indicating the type of waste material to be placed in each compartment;

c) a plurality of removable containers, each to be placed into one compartment for receiving one type of waste material that will be placed therein;

d) means for suspending each of said removable containers within each of the compartments, so that each of the different waste materials can be placed into each of said removable containers and then be removed to facilitate its transportation to a recycling facility; and e) a lid hinged to a top edge of the rear wall of said receptacle, so that when said lid is placed in a closed position it will cover the compartments; and f) said containers having means for size expansion, contraction and closure which cooperates with said means for suspending said containers whereby said containers may be adjusted to a desired size, suspended in said receptacle, removed therefrom and closed for disposal.

* * * * *